US009194246B2

(12) United States Patent
Predmore et al.

(10) Patent No.: US 9,194,246 B2
(45) Date of Patent: Nov. 24, 2015

(54) STEAM TURBINE LP CASING CYLINDRICAL STRUTS BETWEEN STAGES

(75) Inventors: Daniel Ross Predmore, Schenectady, NY (US); Rajendra Gonoor, Bangalore (IN); Erik Eduardo Lopez Partida, Queretaro (MX)

(73) Assignee: General Electric Company, Schenectady, NY (US)

( * ) Notice: Subject to any disclaimer, the term of this patent is extended or adjusted under 35 U.S.C. 154(b) by 1029 days.

(21) Appl. No.: 13/243,576

(22) Filed: Sep. 23, 2011

(65) Prior Publication Data

US 2013/0078088 A1 Mar. 28, 2013

(51) Int. Cl.
*F01D 25/24* (2006.01)
*F01D 9/02* (2006.01)

(52) U.S. Cl.
CPC *F01D 9/02* (2013.01); *F01D 25/24* (2013.01); *F05D 2220/31* (2013.01); *Y10T 29/49323* (2015.01)

(58) Field of Classification Search
CPC ..... F01D 9/02; F01D 11/00; F01D 25/24; F01D 25/26; F01D 25/28; F05D 2220/31; F05D 2220/30
See application file for complete search history.

(56) References Cited

U.S. PATENT DOCUMENTS

| | | | |
|---|---|---|---|
| 6,790,002 | B2 | 9/2004 | Kitazawa et al. |
| 7,625,170 | B2 | 12/2009 | Greene et al. |
| 2003/0061796 | A1 | 4/2003 | Kaijima et al. |
| 2003/0143069 | A1 | 7/2003 | Kitazawa et al. |
| 2004/0156720 | A1 | 8/2004 | Lathrop et al. |
| 2009/0232644 | A1 | 9/2009 | Greene et al. |
| 2010/0054927 | A1 | 3/2010 | Almstedt et al. |

FOREIGN PATENT DOCUMENTS

| | | |
|---|---|---|
| CN | 2639531 | 9/2004 |
| CN | 11321929 | 12/2008 |
| CN | 101752927 | 6/2010 |
| EP | 2148048 | 3/1987 |
| EP | 0335928 | 4/1989 |
| EP | 0465696 | 1/1992 |
| EP | 0559387 | 9/1993 |
| EP | 0620423 | 10/1994 |
| EP | 0657348 | 6/1995 |
| EP | 0735255 | 10/1996 |
| EP | 1905956 | 4/2008 |
| EP | 1918547 | 5/2008 |

(Continued)

OTHER PUBLICATIONS

JP 2003172106 English Machine Translation, Uetsuki Yasuyuki, Jun. 20, 2003.*

*Primary Examiner* — Nathaniel Wiehe
*Assistant Examiner* — Jeffrey A Brownson
(74) *Attorney, Agent, or Firm* — Nixon & Vanderhye P.C.

(57) ABSTRACT

An arrangement is disclosed in which deflections and mechanical stresses in turbine low pressure casings are controlled by inserting struts between the turbine diaphragm ledge ring stages. Preferably, the struts are cylindrical in shape, although other different shapes can be used in accordance with the needs of different applications. The struts can be solid or hollow in construction, although preferably they are hollow to reduce the material needed to fabricate them. The struts are located around the turbine casing, as is required to connect together two ledge rings where there is high axial deflection in the casing.

23 Claims, 3 Drawing Sheets

(56) References Cited

FOREIGN PATENT DOCUMENTS

| | | |
|---|---|---|
| EP | 1930543 | 6/2008 |
| EP | 1988259 | 11/2008 |
| EP | 2096259 | 9/2009 |
| EP | 2101041 | 9/2009 |
| EP | 2116728 | 11/2009 |
| EP | 2151547 | 2/2010 |
| EP | 2177719 | 4/2010 |
| EP | 2180149 | 4/2010 |
| EP | 1954922 | 7/2010 |
| JP | 54109504 | 8/1979 |
| JP | 60195305 | 10/1985 |
| JP | 62129506 | 5/1990 |
| JP | 02241903 | 9/1990 |
| JP | 03124901 | 5/1991 |
| JP | 07083002 | 3/1995 |
| JP | 2001123804 | 5/2001 |
| JP | 2001200706 | 7/2001 |
| JP | 2001289007 | 10/2001 |
| JP | 2602235505 | 8/2002 |
| JP | 2003172106 | 6/2003 |
| JP | 2004036527 | 2/2004 |
| JP | 2007032504 | 2/2007 |
| JP | 2008202419 | 9/2008 |
| JP | 2008248764 | 10/2008 |
| JP | 2009030486 | 2/2009 |
| JP | 2009209697 | 9/2009 |
| JP | 2009243413 | 10/2009 |
| JP | 2010053822 | 3/2010 |
| WO | 8000489 | 3/1980 |
| WO | 8000864 | 5/1980 |
| WO | 9201293 | 1/1992 |
| WO | 0001934 | 1/2000 |
| WO | 0071644 | 11/2000 |
| WO | 02064952 | 8/2002 |
| WO | 2007063088 | 6/2007 |
| WO | 2010023888 | 3/2010 |

* cited by examiner

STEAM TURBINE LP CASING CYLINDRICAL STRUTS BETWEEN STAGES

The present invention relates to steam turbines, and more particularly, to a method and structural arrangement of controlling axial deflection and stiffness of a steam turbine's casing.

BACKGROUND OF THE INVENTION

Steam turbines are machines that are used to generate mechanical (rotational motion) power from the pressure energy of steam. Steam turbines are comprised of a number of different size stages. Each stage has a set of moving and fixed blades. The moving blades are attached to the turbine's rotor, while the stationary blades are called a diaphragm. The diaphragm guides the steam to glide over the moving blades for producing rotary motion.

To maximize turbine efficiency, the steam is expanded as it flows through the turbine, generating work in the multiple stages of the turbine. These stages are characterized by how the energy is extracted from them and are known as either impulse or reaction turbines. In an impulse turbine, a stage is a set of moving blades behind the nozzle. In a reaction turbine, each row of blades is called a "stage".

One problem which occurs in the operation of turbines is the occurrence of axial deflections and mechanical stresses in low pressure ("LP") turbine casings. These axial deflections and mechanical stresses are conventionally controlled through the use of axially extending continuous internal ribs connecting all of the ledge rings in the turbine's LP casing. Ledge rings are the plates in an LP turbine casing which contain the steam seal faces with diaphragms. When axial defection is controlled through the use of continuous ribs connected to the inside surface of a turbine's LP casing between ledges, a lot of material and welding and manufacturing time is required, which can be expensive.

Controlling axial deflections and mechanical stresses in LP turbine casings can be further achieved by increasing the thickness of the ledge rings. However, after the thickness of the ledge rings has reached a certain thickness, it is no longer advantageous, cost wise to further increase the thickness of the ledge rings.

BRIEF DESCRIPTION OF THE INVENTION

In the present invention, deflections and mechanical stresses in LP turbine casings are controlled by inserting struts or sections between the turbine diaphragm ledge ring stages to control the axial deflections of ledge rings. Preferably, the struts or sections are cylindrical in shape, although it should be noted that any other different shapes can be used per the needs of a given application. Also, the struts can be solid or hollow in construction, although preferably they are hollow to reduce the material and thus the cost of fabricating them. Preferably, the struts are constructed from low carbon steel; however, it should be noted that other metals capable of meeting the needs of a given application in which struts would be used may also be used.

Preferably, the struts also have a predetermined required diameter so that when they are used between turbine ledge rings stages they are able to control the axial deflection and stiffness of the turbine casing without failing. Typically, the struts are 4" in diameter, but it should be noted that this diameter can vary, depending on the degree of axial movements to be controlled, with larger diameter struts being used to control higher levels of axial movement. In addition, preferably, the cylindrical sections are positioned away from the LP casing wrapper, which decreases the welding needed to position the cylindrical sections between the turbine ledge rings stages. This arrangement avoids the welding of conventional ribs to the turbine casing. Connecting the struts to the ledge rings avoids the need for welding to the turbine's casing wrapper. As such, the cost of controlling deflections and mechanical stresses in turbine casings can be decreased in terms of the material and fabrication and welding time needed to fix this kind of problem. Preferably, the struts are positioned so as to connect two ledge rings together where there is high axial movement. "High axial movement" is considered to exist where the axial movements of the ledge rings are non uniform and more than the axial clearances provided.

In the present invention, the struts replace the continuous ribs. The struts add flexibility in being able to be positioned in locations where there is high axial deflection. The struts can be arranged at any "clock" location around the circumference of the turbine casing, as is required. The struts do not need to be welded to the turbine casing. Rather, they can be connected by welding them directly to the ledge rings so that they are away from the casing wrapper, unlike internal ribs. This arrangement decreases the amount of welding and manufacturing complexity needed to install the struts. The result is that axial deflection can be controlled more effectively with less material and manufacturing time and less complexity. In addition, cost is decreased in terms of the material, fabrication and welding time needed to install the struts.

In a first exemplary embodiment of the invention, a structural arrangement for controlling axial deflection and stiffness in the casing of a steam turbine including a plurality of ledge rings positioned axially along the casing between turbine stages comprises a plurality of struts connected between the plurality of ledge rings, each strut being connected between two ledge rings, the positioning of the struts being determined so as to be located where there is high axial movement in the turbine casing.

In another exemplary embodiment of the invention, a structural arrangement for controlling axial deflection and stiffness in the casing of a steam turbine including a plurality of ledge rings positioned axially along the casing between turbine stages comprises a plurality of struts connected between the plurality of ledge rings, each strut being connected between two ledge rings, so as to be separated away from the casing's wrapping, the plurality of struts are positioned between two ledge rings at a plurality of locations around the circumference of the casing and along the axial length of the casing, whereby, axial deflection in and stiffness of the casing are controlled by the positioning of the struts.

In a further exemplary embodiment of the invention, a method of controlling axial deflection and stiffness in the casing of a steam turbine that includes a plurality of ledge rings positioned axially along the casing between turbine stages comprises the steps of connecting a plurality of struts between the plurality of ledge rings, each strut being connected between two ledge rings, and positioning the plurality of struts so that the struts are located around the circumference of the casing and along the axial length of the casing.

DETAILED DESCRIPTION OF THE INVENTION

A low pressure (LP) turbine is a pressure compounded, either single or dual axial flow, condensing reaction turbine. The LP turbine is typically located next to a high pressure (HP) turbine. In dual axial flow LP turbines, steam enters the center of the turbine from a conical shaped inlet pipe 22 through which steam from a crossover pipe (not shown) enters the center of the turbine casing 10 and flows across the reaction blading in two opposite directions. The steam flows parallel to the turbine's rotor and exhausts into a main condenser.

Figure 1:
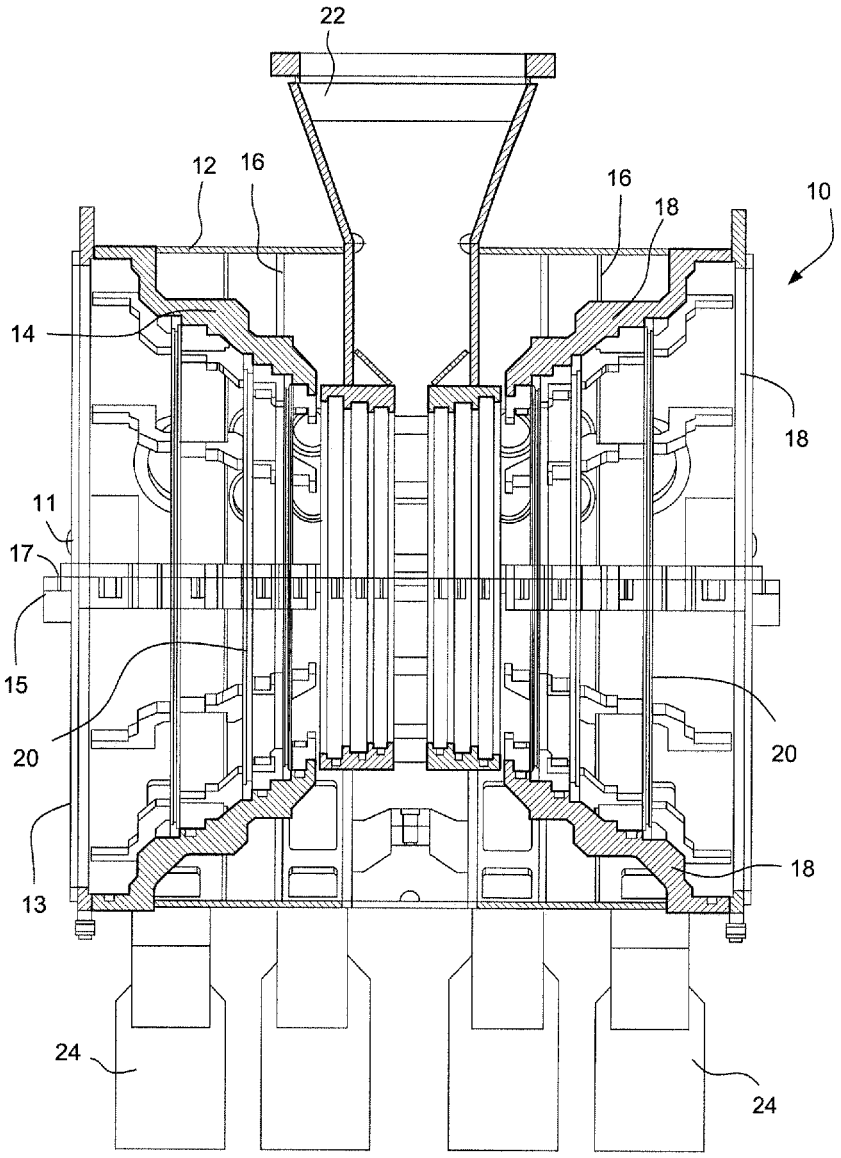
FIG. 1 is a cross sectional elevational view of a conventional double shell continuous cylindrical casing for a dual axial flow low pressure steam turbine including continuous internal ribs.

FIG. 1 is a cross sectional elevational view of a conventional double shell continuous cylindrical extraction casing 10 for a dual axial flow LP steam turbine. Extraction casing 10 has an upper half 11 and a lower half 13, which are bolted together at a horizontal point 17 by a plurality of bolts (not shown) so as to create a metal to metal fit that is sealed. Extending along horizontal joint 17 are a plurality of diaphragm support pockets 15 for supporting the diaphragms (not shown) between the multiple stages in casing 10.

In an extraction type turbine, steam is released from various stages of the turbine, and used for industrial process needs or sent to boiler feedwater heaters to improve overall cycle efficiency. Conventionally, an extraction casing is constructed in a double shell configuration due to extractions. To satisfy the extraction area the diaphragm pockets are supported away from the shell major structure.

Casing 10 includes a continuous cylindrically shaped outer shell 12 with a plurality of circularly shaped ledge rings 16. Casing 10 also includes an inner shell 14 with a plurality of circularly shaped ledge rings 20 connected together by axially extending continuous internal ribs 18. Internal ribs 18 are circularly shaped. The axially extending continuous internal ribs 18 connecting together the ledge rings 20 in the turbine's casing serve to control axial deflections and mechanical stresses that may occur in the casing 10. The casing 10 also includes a conical shaped cross over pipe 22 through which steam enters the center of the turbine casing 10 and flows across the reaction blading in two opposite directions. The casing 10 is also connected to a plurality of steam extraction pipes 24.

Figure 2:
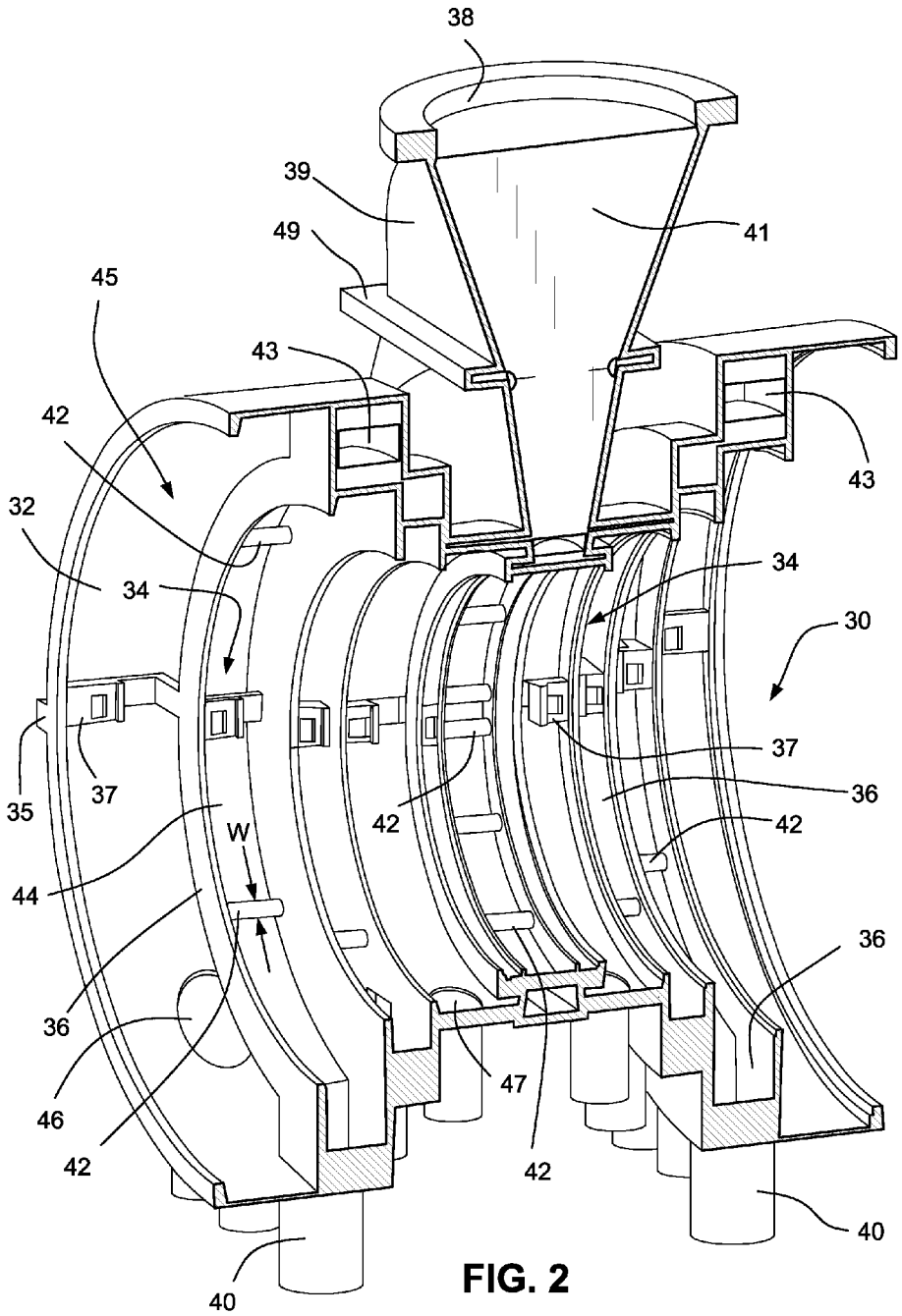
FIG. 2 is a cross sectional elevational view of a single shell stepped casing for a dual axial flow low pressure steam turbine constructed according to the present invention with cylindrically shaped struts.

FIG. 2 is a cross sectional perspective, elevational view of a single shell stepped structure extraction casing 30 for a dual axial flow steam turbine, like an LP steam turbine, that excludes the axially extending continuous internal ribs 18 used with the casing 10 shown in FIG. 1 and that includes the strut arrangement of the present invention. The casing 30 has an upper half 31 and a lower half 33, which are bolted together at a horizontal joint 35 by a plurality of bolts (not shown) so as to create a metal to metal fit that is sealed. Extending along horizontal joint 35 are a plurality of diaphragm support pockets 37 for supporting diaphragms (not shown) between the multiple stages 44 in casing 30.

The casing 30 includes a stepped shell structure formed from a plurality of circumferentially shaped ledge rings 36 located along the axial length of casing 30 between turbine stages (not shown) and covered by a casing wrapper 32. The casing 30 also includes a conical shaped inlet pipe 39 through which steam from a crossover pipe (not shown) enters the center of the turbine casing 30 and flows across the reaction blading in two opposite directions. This crossover pipe is connected to inlet pipe at an inlet crossover ring 38. Surrounding inlet pipe 39 is an inlet flange 49. In the center of inlet pipe 39 is a stiffening plate 41. Connected to the casing 30 is a plurality of steam extraction pipes 40. Steam is extracted partly from inner shell 34 through extraction pockets 43, after which it passes through an a conduit area 45 between inner shell 34 and outer shell 32 and through openings 46 into steam extraction pipes 40. Steam is also extracted through openings 47 in inner shell 34.

Deflections and mechanical stresses in the turbine casing 30 are controlled by inserting struts or sections 42 between the turbine ledge rings 36 between stages to control the axial deflections of the ledge rings 36. Preferably, the struts 42 are cylindrical in shape, although it should be noted that other different shapes can be used in accordance with the needs of different applications. Also, the struts can be solid or hollow in construction, although preferably they are hollow to reduce the material and thus the cost of fabricating them.

Preferably, the struts 42 also have a predetermined diameter or width W, as shown in FIG. 2, so that when they are used between turbine ledge rings 36 they are able to control the axial deflection and stiffness of the turbine casing 30 without failing. In addition, preferably, the struts 42 are positioned away from the casing wrapper or outer shell 32, which decreases the welding needed to position the struts 42 between the turbine ledge rings 36. As such, the cost of controlling deflections and mechanical stresses in turbine casings can be decreased in terms of the material and fabrication and welding time needed to fix this kind of problem. Preferably, the struts 42 are positioned so as to connect two ledge rings together where there is high axial movement.

In the present invention, the struts 42 replace the continuous ribs 18. The struts 42 add flexibility in being able to be positioned in locations where there is high axial deflection. The struts can be arranged at any "clock" location around the circumference of the turbine casing 30, as is required. Thus, the number of struts 42 used in a given turbine casing will be determined by the number of axial deflections and mechanical stresses in a given casing. The struts 42 do not need to be welded to the turbine casing 30. Rather, they can be connected directly to the ledge rings 36 so that they are away from the casing wrapper 32, unlike the internal ribs 18. This arrangement decreases the amount of welding and manufacturing complexity needed to install the struts.

Figure 3:
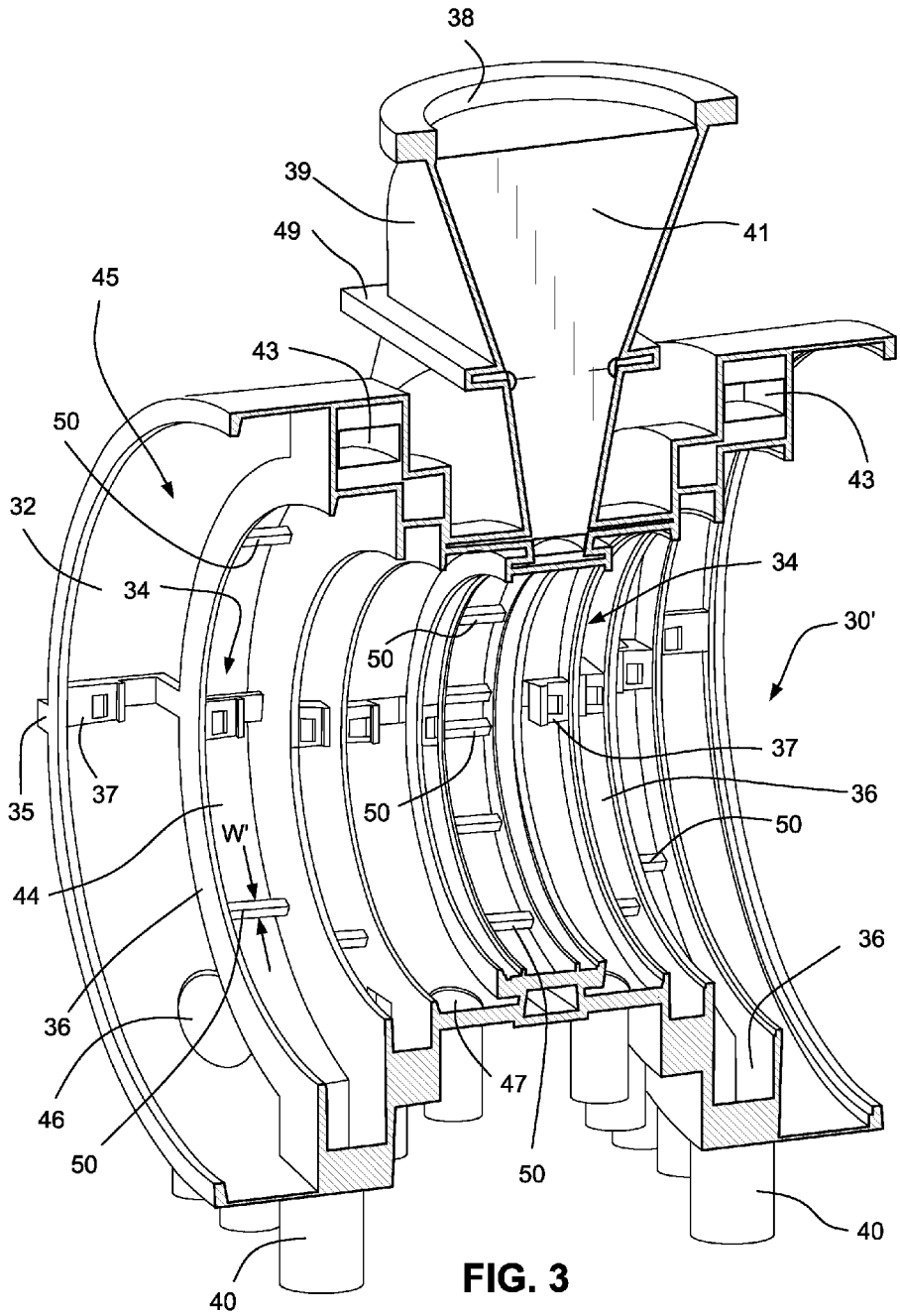
FIG. 3 is a cross sectional elevational view of a single shell stepped casing for a dual axial flow low pressure steam turbine constructed according to the present invention with square shaped struts.

FIG. 3 is another cross sectional perspective, elevational view of a single shell stepped structure extraction casing 30' for a dual axial flow steam turbine, like an LP steam turbine, that excludes the axially extending continuous internal ribs 18 used with the casing 10 shown in FIG. 1 and that includes the strut arrangement of the present invention. The construction of the casing shown in FIG. 3 is identical to that of the single shell stepped structure extraction casing 30 shown in FIG. 2, except that the cylindrically shaped struts 42 are replaced with square shaped struts 50. Here again, preferably, the struts 50 also have a predetermined diameter or width W', as shown in FIG. 3, so that when they are used between turbine ledge rings 36 they are able to control the axial deflection and stiffness of the turbine casing 30 without failing.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An arrangement for controlling axial deflection and stiffness in the casing of a steam turbine including a wrapper and ledge rings positioned axially along the casing between turbine stages, the arrangement comprising:

struts extending axially between and connected directly to adjacent pairs of the ledge rings;

the struts between each of the adjacent pairs of ledge rings form a circular array wherein the struts are at different positions on the circumference of the circular array, and wherein the axes of the struts of at least one of the circular arrays are not aligned with the axis of any strut in another one of the circular arrays.

2. The arrangement of claim 1, wherein the struts are connected between the plurality of ledge rings by welding.

3. The arrangement of claim 1, wherein each strut is welded between two ledge rings so as to be separated away from the casing wrapper.

4. The arrangement of claim 1, wherein each of the struts has a cylindrical shape.

5. The arrangement of claim 4, wherein each of the struts has a predetermined diameter.

6. The arrangement of claim 1, wherein each of the struts is square in cross section.

7. The arrangement of claim 6, wherein each of the struts has a predetermined width in cross section.

8. The arrangement of claim 1, wherein the plurality of struts are positioned between two ledge rings at a plurality of locations around the circumference of the casing and along the axial length of the casing.

9. The arrangement of claim 1, wherein each of the struts is constructed from a steel metal.

10. The arrangement of claim 1, wherein each of the struts has a solid construction.

11. The arrangement of claim 1, wherein each of the struts has a hollow construction.

12. An arrangement for controlling axial deflection and stiffness in the casing of a steam turbine including a wrapper and ledge rings positioned axially along the casing between turbine stages, the arrangement comprising:

struts extending axially between pairs of the ledge rings, each strut being connected directly to each ledge ring of the pair of ledge rings and each strut separated from the casing wrapper, the struts between each pair of ledge rings being arranged in a circular array wherein the struts are positioned at different positions around the circumference of the array, and the struts between a first one of the pairs of the ledge rings are not coaxial with the axes of the struts in a second one of the pairs of ledge rings, wherein the first pair of ledge rings is adjacent the second pair of ledge rings along the axial length of the casing, and whereby, axial deflection in and stiffness of the casing are controlled by the positioning of the struts.

13. The arrangement of claim 12, wherein each of the struts has a cylindrical shape.

14. The arrangement of claim 13, wherein each of the struts has a predetermined diameter.

15. The arrangement of claim 12, wherein each of the struts is square in cross section.

16. The arrangement of claim 15, wherein each of the struts has a predetermined width in cross section.

17. The arrangement of claim 12, wherein each of the struts has a solid construction.

18. The arrangement of claim 12, wherein each of the struts has a hollow construction.

19. A method of controlling axial deflection and stiffness in the casing of a steam turbine that includes a wrapper and ledge rings positioned axially along the casing between turbine stages, the method comprising:

positioning a first set of struts between a first pair of adjacent ledge rings, wherein the struts of the first set extend axially and are arranged in a circular array with each strut at a different position on the circumference of the circular array;

connecting the first set of struts to the first pair of adjacent ledge rings;

positioning a second set of struts between a second pair of adjacent ledge rings, wherein the struts of the second set extend axially and are arranged in a circular array with each strut at a different position on the circumference of the circular array, wherein the axes of the second set of struts do not extend along a same line as any of the axes of the first set of struts;

connecting the second set of struts to the second pair of ledge rings, and suppressing axial deformation of the casing due to the struts connected to the ledge rings.

20. The method of claim 19, wherein the step of positioning the struts comprises positioning each of the struts at the position where there is axial deflection in the turbine casing.

21. The method of claim 19, wherein the steps of connecting each strut between the pair of ledge rings comprises welding each strut to the pair of ledge rings so as to be separated away from the wrapper.

22. The arrangement of claim 1, wherein each of the plurality of struts has a cross sectional size that is selected based on a particular turbine application in which the struts are used.

23. The method of claim 19, wherein each of the plurality of struts has a cross sectional size that is selected based on a particular turbine application in which the struts are used.

* * * * *